US006687479B2

(12) United States Patent
Leute et al.

(10) Patent No.: US 6,687,479 B2
(45) Date of Patent: Feb. 3, 2004

(54) PAPER INPUT GUIDE FOR A TRANSFER ZONE IN A XEROGRAPHIC PRINTING APPARATUS

(75) Inventors: Gerardo Leute, Penfield, NY (US); John W. D. Cooper, Hertfordshire (GB); Ian Brailsford, Hertfordshire (GB); Stan Alan Spencer, Rochester, NY (US); Roger D. Masham, Hertfordshire (GB); Derek J. Milton, Hertfordshire (GB); Robert G. Hall, Hertfordshire (GB); Roderick A. Cooley, Hertfordshire (GB); John M. Wysocky, Rochester, NY (US); Charles H. Tabb, Rochester, NY (US); Jorge A. Alvarez, Webster, NY (US); Alexander C. Bisland, Hertfordshire (GB); Peter A. Mayfield, Hertfordshire (GB); Clifford W. Imes, IV, Rochester, NY (US); Peter J. M. Bloemen, Cuijk (NL); Michael B. Thomson, Hertfordshire (GB); Krzysztof J. Less, London (GB); David G. Anderson, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/160,813

(22) Filed: May 31, 2002

(65) Prior Publication Data

US 2003/0223787 A1 Dec. 4, 2003

(51) Int. Cl.[7] ..... G03G 15/16

(52) U.S. Cl. ..... 399/316; 399/388

(58) Field of Search ..... 399/316, 317, 399/388, 44

(56) References Cited

U.S. PATENT DOCUMENTS

| | | | | |
|---|---|---|---|---|
| 3,620,617 A | | 11/1971 | Kelly et al. | |
| 3,850,519 A | | 11/1974 | Weikel, Jr. et al. | |
| 4,891,680 A | | 1/1990 | Gross et al. | |
| 5,594,539 A | * | 1/1997 | Murano et al. | 399/316 |
| 5,752,134 A | * | 5/1998 | Hazama et al. | 399/316 X |
| 6,055,395 A | * | 4/2000 | Hiramoto | 399/316 X |
| 6,345,168 B1 | | 2/2002 | Pitts | 399/314 |

* cited by examiner

*Primary Examiner*—William J. Royer
(74) *Attorney, Agent, or Firm*—R. Hutter

(57) ABSTRACT

A printing apparatus includes a guide member for directing sheets toward a transfer zone. The guide member defines a set of ribs which hold the sheets above the main surface of the guide member. Thus, any stray marking material which lands on the guide member is relatively unlikely to contact a sheet moving over the guide member.

22 Claims, 1 Drawing Sheet

PAPER INPUT GUIDE FOR A TRANSFER ZONE IN A XEROGRAPHIC PRINTING APPARATUS

TECHNICAL FIELD

The present invention relates to electrostatographic or xerographic printing, and more specifically relates to a paper input guide for use near a transfer zone, where an image on a charge receptor is electrostatically transferred to a sheet, such as a sheet of paper.

BACKGROUND

The basic process steps of electrostatographic printing, such as xerography or ionography, are well known. Typically an electrostatic latent image is created on a charge receptor, which in a typical analog copier or "laser printer" is known as a photoreceptor. The suitably charged areas on the surface of the photoreceptor are developed with fine toner particles, creating an image with the toner particles which is transferred to a print sheet, which is typically a sheet of paper but which could conceivably be any kind of substrate. This transfer is typically carried out by the creation of a "transfer zone" of AC and DC biases where the print sheet is in contact with, or otherwise proximate to, the photoreceptor. In general, the AC bias dislodges the toner particles which were adhering electrostatically to the photoreceptor, while the DC bias, also known as a "detack voltage," causes the toner particles to be attracted in image-wise fashion to the print sheet, thus transferring the image from the photoreceptor to the print sheet. Devices to create this transfer zone, such as corotrons, are well known.

In compact designs of xerographic printers and copiers, the close proximity of various imaging stations to one another can be a source of print defects. Specifically, in one configuration where the transfer zone is near the six o'clock position of a cylindrical photoreceptor, and the development zone is near, for example, the nine o'clock position, excess marking material, such as toner or developer, is likely to drop at various times into the paper path through which unmarked paper passes to reach the transfer zone. The presence of such marking material in the path is likely to smudge or make marks on the sheets, resulting in a print defect.

DESCRIPTION OF THE PRIOR ART

U.S. Pat. No. 3,620,617 discloses a xerographic printer in which the upward-facing opening of a transfer corotron is partially covered with a Mylar® flap. The flap prevents marking material from entering and contaminating the transfer corotron.

U.S. Pat. No. 3,850,519 discloses a xerographic printer in which the upward-facing opening of a transfer corotron is partially covered by a shield, which is electrically grounded. The shield prevents ions from the transfer corotron from affecting the transfer process before a sheet enters the transfer zone.

U.S. Pat. No. 4,891,680 discloses a xerographic printer in which the opening of a transfer corotron is contiguous with a sheet guide. The sheet guide maintains a copy sheet wrinkle-free as it enters the transfer zone.

U.S. Pat. No. 6,345,168 discloses a guide member upstream of a transfer zone in a xerographic printer.

SUMMARY OF THE INVENTION

According to one aspect of the present invention, there is provided a printing apparatus comprising a charge receptor, and means defining a transfer zone associated with the charge receptor. A guide member is associated with the transfer zone, the guide member defining a plurality of ribs thereon, the ribs being suitable for supporting a print sheet moving in a process direction relative to the transfer zone.

According to another aspect of the present invention, there is provided a printing apparatus comprising a charge receptor, and means defining a transfer zone associated with the charge receptor. A guide member is disposed upstream of the transfer zone along the process direction, the guide member defining an upper surface. Biasing means bias the guide member.

DETAILED DESCRIPTION

Figure 1:
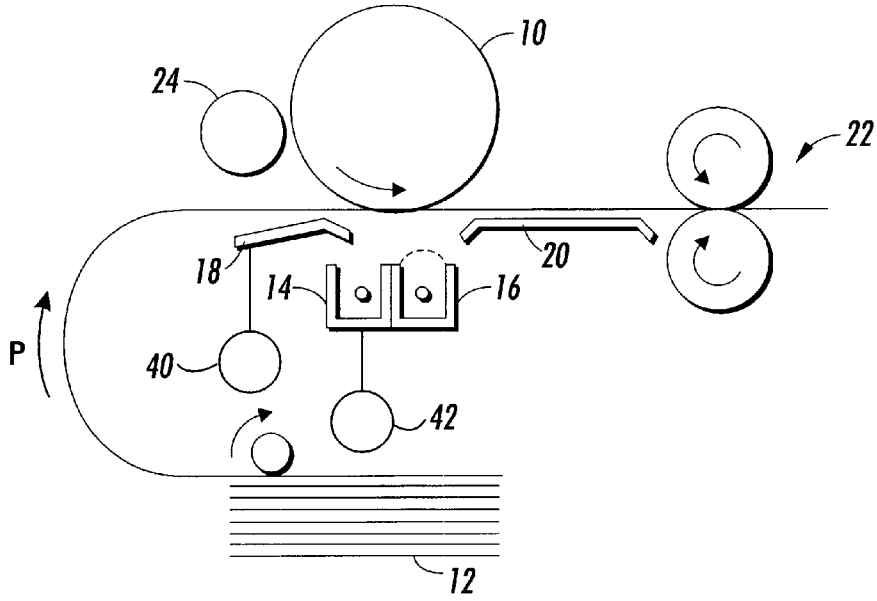
FIG. 1 is a simplified elevational diagram showing some essential elements of an electrostatographic printing apparatus, such as a printer or copier.

FIG. 1 is a simplified elevational diagram showing some essential elements of an electrostatographic printing apparatus, such as a printer or copier. As is familiar in electrostatographic printing, in particular ionography or xerography, electrostatic latent images are created on the surface of a charge receptor, such as the photoreceptor indicated as 10. (The ancillary elements typically associated with such a printer, such as a charge corotron, exposure device, and so forth, are not shown but would be apparent to one of skill in the art. Also, a "charge receptor" for present purposes can be an intermediate member, such as a belt, on which successive toner or liquid ink images are accumulated before final transfer, such as in color xerography, or in ink-jet printing.) The sheets on which images are desired to be printed are drawn from a stack 12 and brought, through a process direction marked P, into a "transfer zone" which, depending on a particular design of the apparatus typically involves contact or proximity of the sheet with the surface of the photoreceptor 10. As the term is used herein, the transfer zone is the location in which the sheet is presented to the charge receptor to receive marking material therefrom, and then detached from the charge receptor, such as to be directed to a fusing apparatus.

When a sheet is passed through the transfer zone through a process direction P, first a leading edge and then finally trailing edge of the sheet is presented to the charge receptor. In the particular illustrated embodiment, there is provided, in the transfer zone, two charge emitting devices, a transfer corotron 14, and a detack corotron 16. The basic design of such corotrons are well known in the art; the essential function of each corotron is to emit charge of a certain magnitude and polarity into at least a portion of the transfer zone. More specifically, transfer corotron 14 is intended to electrostatically dislodge the marking material on the surface of photoreceptor 10 so that it adheres to the sheet, while the function of detack corotron 16 is to use electrostatic forces to detach the sheet from the surface of photoreceptor 10. In other conceivable embodiments, the functions of transfer and detack can be combined in a single corotron, or alternately the transfer functions can be carried out by the use of a biased transfer roll which forms a nip with the photoreceptor 10, through which the sheets pass.

Typically, there is provided adjacent to the transfer zone various paper guides to ensure suitable interaction between a sheet and the photoreceptor 10. Typical of such guides include a "guide member" 18, which typically extends over the effective area of a transfer corotron 14, and a paper path guide 20, which guides a sheet from the transfer zone toward the nip of a fusing apparatus 22.

Also shown FIG. 1 is a developer roll 24, which is a typical element of a development station. As is well known in xerography, such a developer roll 24 presents a supply of marking material such as toner particles to an electrostatic latent image formed on the surface of the photoreceptor 10; the toner particles are attracted to the suitably-charged areas on the photoreceptor 10, typically those areas which will correspond to the desired "print-blacks" areas on the printed sheet. The development station may exploit a magnetic brush, AC jumping development, or any other technique familiar in the art.

It can be seen FIG. 1 that, in a compact printer design, the developer roll 24 is disposed substantially above the guide member 18. It is possible that stray toner or other marking particles may drop from the developer roll 24 onto the guide member 18. Of course, as sheets from stack 12 are caused to pass over the guide member 18, one or both sides of a sheet may contact a stray quantity of toner particles, resulting in a print defect in the finished print.

Figure 2:
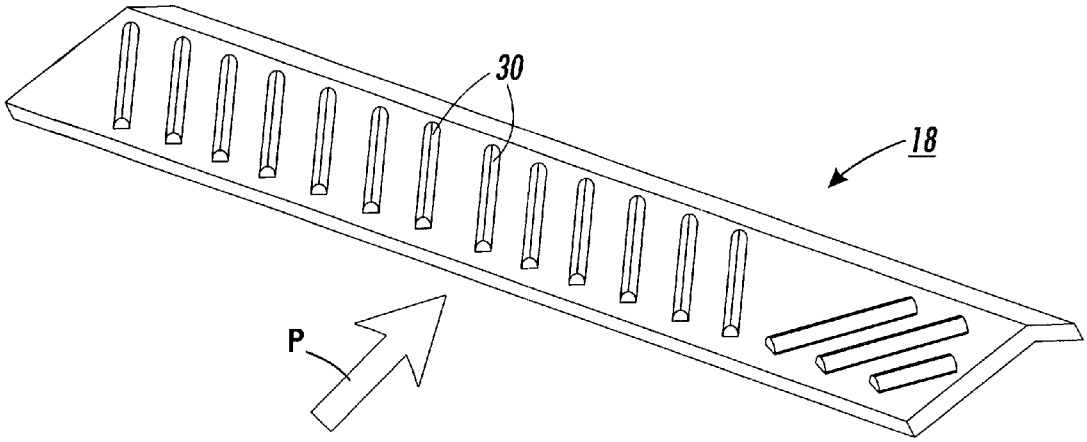
FIG. 2 is a perspective view of a guide member, in isolation.

FIG. 2 is a perspective view of one embodiment of guide member 18, in isolation. As shown, there is provided a series of ribs 30 which extend along the paper path direction. The ribs 30, in this embodiment, are about 2 mm wide along the transverse direction perpendicular to the paper path direction, 1–3 mm in height relative to the main upper surface of guide member 18, and are shaped so that about 1 mm each rib 30 contacts the sheet along the transverse direction. Along the transverse direction, the profile of each rib 30 may be semicircular, rectangular, trapezoidal, or triangular.

Further as shown in FIG. 2, the spacing between adjacent ribs 30 is about 16 mm to 22 mm. In the illustrated embodiment, the ribs 30 are angled relative to the process direction P by about 20 degrees, with a subset of ribs 30 being angled in one direction and the remaining ribs 30 angled in an opposite direction: the position at which the angled ribs change direction depends on the position of the paper top edge as it passes over the guide member 18. The location of each angled rib 30 depends on the expected sizes of sheets passing over the guide member 18. However, it can be seen that the ribs 30 are angled "outward," toward the sides of the paper path, along the process direction so as to ensure a rib 30 is always moving away from a paper edge as it travels over the guide member 18.

Returning to FIG. 1, it can be seen that the guide member 18 is biasable, such as by biasing means 40, which are controlled by a general control system (not shown) for the whole printer; the bias on the transfer corotron 14, provided by a transfer biasing means 42, is coordinated with the bias on guide member 18 as a sheet passes through the system. Biasing means 40 is controlled to operate independently from the transfer biasing means 42, in terms of polarity (one can be negative while the other is positive; for present purposes a zero bias can count as a different or opposite polarity), absolute voltage, and the time of activation during the printing process. In one embodiment, the bias on guide member 18 is zero at times when a sheet is passing over the top surface thereof, and is switched to −500V during cycle in, cycle out and the interprint gap. (Cycle in refers to the time that the machine takes to start up, start imaging and feed paper into the transfer zone. Cycle out refers to the time that the machine takes to transport the printed sheet into the output tray and close the process engine down. The interprint gap is when the machine is running but at moments when there is no sheet passing over the guide member 18.) Also, the guide member bias during the time a sheet is passing thereover switches from 0V to +400V when the internal machine humidity is at or above a predetermined threshold humidity level, such as 60%. Simultaneously, in this embodiment, the bias on transfer corotron 14 is at a constant level (in this embodiment, approximately 300 micro amps constant positive charge rate, although in some designs it may be helpful to reduce the transfer bias for low humidities) while a sheet is passing through the transfer zone but is switched to zero for cycle in, cycle out, and in the interprint area for all humidity conditions. This is done to prevent a phenomenon called ghosting where a latent charge image of a previous print is created and developed out on a subsequent print.

The ribs 30 on the guide member 18 have a dual function: they form a small area for toner particles to be deposited on and they also constrain the paper to touch only the rib surface. The location, height, and spacing of the ribs 30 prevent paper touching the flat surface between the ribs 30. The rib 30 locations are chosen so that side edges of the paper (along the process direction) do not correspond exactly with a rib position, which avoids bent down paper corners catching on a rib 30. The paper constraining action makes almost every sheet passing through the machine wipe the rib surface so that the paper takes away contamination before it can build up on the rib 30. Furthermore, the angle of the ribs 30 presents an edge moving away from the paper feed direction, allowing paper to move and relieve stresses perpendicular to the process direction as the paper moves over the guide member 18.

The bias on guide member 18 assists in keeping the ribs 30 clean by reducing the attractive electric field for toner particles between the photoreceptor 10 and the guide member 18. It also helps to keep any non ribbed, flat parts of the guide member 18 clean by the same action; in the illustrated embodiment, the non-ribbed part of guide member 18 is closest to the surface of the photoreceptor 10, where the electric field which would normally attract toner particles to the guide is the strongest. A high humidity is more stressful as the guide member 18 is normally biased to +400V in high humidity to assist transfer of the toner particles to the paper, which will attract more of the negatively charged toner. By switching to −500V bias in the interprint gap and cycle in/out the attractive field is minimized or reversed. In ambient and low humidities the guide member bias is normally at zero; switching to −500V bias in the interprint gap and cycle in/out is also applied to minimize the attractive electric field.

Although an electrostatographic embodiment is shown, a guide member according to the present invention can also be used in an ink-jet printer where a printhead creates on image on an intermediate belt or drum, which is subsequently transferred to a sheet by electrostatic or other means. In such a case, the printhead could be considered a "development station".

What is claimed is:

1. A printing apparatus comprising:

a charge receptor;

means defining a transfer zone associated with the charge receptor; and a guide member associated with the transfer zone, the guide member defining a plurality of ribs thereon, the ribs being suitable for supporting a print sheet moving in a process direction relative to the transfer zone, the ribs being spaced approximately 16 mm to 22 mm apart.

2. The apparatus of claim 1, the ribs extending substantially along the process direction.

3. A printing apparatus comprising:

a charge receptor means defining a transfer zone associated with the charge receptor; and a guide member associated with the transfer zone, the guide member defining a plurality of ribs thereon, the ribs being suitable for supporting a print sheet moving in a process direction relative to the transfer zone, the ribs having a height of about 1–2 mm relative to the main surface of the guide member.

4. A printing apparatus comprising:

a charge receptor;

means defining a transfer zone associated with the charge receptor; and a guide member associated with the transfer zone, the guide member defining a plurality of ribs thereon, the ribs being suitable for supporting a print sheet moving in a process direction relative to the transfer zone, at least a subset of the ribs being oriented diagonally relative to the process direction.

5. The apparatus of claim 4, a first subset of the ribs being oriented in a first direction diagonally relative to the process direction and a second subset of the ribs being oriented in a second direction diagonally relative to the process direction.

6. The apparatus of claim 5, wherein the first subset of the ribs and the second subset of the ribs together are oriented outward along the process direction.

7. A printing apparatus comprising:

a charge receptor;

means defining a transfer zone associated with the charge receptor;

a guide member associated with the transfer zone, the guide member defining a plurality of ribs thereon, the ribs being suitable for supporting a print sheet moving in a process direction relative to the transfer zone; and biasing means for biasing the guide member, wherein the biasing means biases the guide member in a predetermined manner in response to a predetermined humidity condition.

8. A printing apparatus comprising:

a charge receptor;

means defining a transfer zone associated with the charge receptor;

a guide member associated with the transfer zone, the guide member defining a plurality of ribs thereon, the ribs being suitable for supporting a print sheet moving in a process direction relative to the transfer zone; and biasing means for biasing the guide member, wherein the biasing means biases the guide member to a first polarity when a print sheet is passing thereover, and biases the guide member to a second polarity at another time.

9. The apparatus of claim 8, the guide member being disposed upstream of the transfer zone along the process direction.

10. The apparatus of claim 8, further comprising a development station, and the guide member being disposed below the development station.

11. A printing apparatus comprising:

a charge receptor;

means defining a transfer zone associated with the charge receptor;

a guide member associated with the transfer zone, the guide member defining a plurality of ribs thereon, the ribs being suitable for supporting a print sheet moving in a process direction relative to the transfer zone; and biasing means for biasing the guide member, wherein the biasing means biases the guide member in a predetermined manner in response to a predetermined humidity condition.

12. A printing apparatus comprising:

a charge receptor;

means defining a transfer zone associated with the charge receptor;

a guide member associated with the transfer zone, the guide member defining a plurality of ribs thereon, the ribs being suitable for supporting a print sheet moving in a process direction relative to the transfer zone; and biasing means for biasing the guide member, wherein the biasing means biases the guide member to a first bias when a print sheet is passing thereover, and biases the guide member to a second bias at another time.

13. The apparatus of claim 12, wherein the biasing means biases the guide member to a first polarity when a print sheet is passing thereover, and biases the guide member to a second polarity at another time.

14. The apparatus of claim 12, further comprising a transfer device associated with the transfer zone; and transfer bias means for biasing the transfer device independently of the biasing means biasing the guide member.

15. The apparatus of claim 14, the transfer bias means biasing the transfer device to a polarity opposite a polarity of the biasing means biasing the guide member.

16. The apparatus of claim 12, the guide member defining a plurality of ribs thereon, the ribs being suitable for supporting a print sheet moving in a process direction relative to the transfer zone.

17. The apparatus of claim 16, the ribs being spaced approximately 16 mm to 22 mm apart.

18. The apparatus of claim 16, the ribs having a height of about 1–2 mm relative to the main surface of the guide member.

19. The apparatus of claim 16, at least a subset of the ribs being oriented diagonally relative to the process direction.

20. The apparatus of claim 19, a first subset of the ribs being oriented in a first direction diagonally relative to the process direction and a second subset of the ribs being oriented in a second direction diagonally relative to the process direction.

21. The apparatus of claim 20, wherein the first subset of the ribs and the second subset of the ribs together are oriented outward along the process direction.

22. The apparatus of claim 12, further comprising a development station, and the guide member being disposed below the development station.

* * * * *